US005497894A

United States Patent [19]

Krupa et al.

[11] Patent Number: 5,497,894

[45] Date of Patent: Mar. 12, 1996

[54] CLAMSHELL CONTAINER FOR FOOD ITEMS

[76] Inventors: Calvin S. Krupa, 750 Navajo Rd., Medina, Minn. 55340; Robert Knoss, 19081 Hopi St., Anoka, Minn. 55303

[21] Appl. No.: 382,977

[22] Filed: Feb. 3, 1995

[51] Int. Cl.[6] ..... B65D 6/28

[52] U.S. Cl. ..... 220/4.23; 220/324; 220/366.1

[58] Field of Search ..... 220/6, 4.01, 4.22, 220/4.23, 4.24, 366.1, 324, 339; 206/470, 471, 365

[56] References Cited

U.S. PATENT DOCUMENTS

| | | | |
|---|---|---|---|
| 3,704,545 | 12/1972 | Van Reisen . | |
| 3,790,061 | 2/1974 | Pignato | 220/324 |
| 4,732,273 | 3/1988 | DeMarco . | |
| 4,921,096 | 5/1990 | McFarlane | 206/349 |
| 5,224,598 | 7/1993 | Angeles et al. . | |
| 5,310,070 | 5/1994 | Haas et al. | 220/366.1 |
| 5,435,449 | 7/1995 | Gelardi | 220/339 |

FOREIGN PATENT DOCUMENTS

| | | | |
|---|---|---|---|
| 2278104 | 11/1994 | United Kingdom | 220/4.22 |

*Primary Examiner*—Stephen J. Castellano
*Attorney, Agent, or Firm*—Haugen and Nikolai

[57] ABSTRACT

A container for storing, transporting and displaying food products such as asparagus is disclosed. The container is a single molded piece of plastic having a base and a pair of cover members pivotally secured to the base by a living hinge. The base provides a first chamber having a top opening. The cover members, when latched together, form both a second chamber having a bottom opening aligned with the top opening of the base and a pair of opposing vents. the alignment of the openings in the two chambers permits elongated food products such as asparagus, celery or carrots to be stored and displayed in an upright fashion.

3 Claims, 5 Drawing Sheets

CLAMSHELL CONTAINER FOR FOOD ITEMS

BACKGROUND OF THE INVENTION

This invention relates to a package for long, thin food products such as asparagus, celery, carrots, or the like. More specifically, this invention relates to a single molded plastic package having a base and a pair of clamshell cover members. The cover members integral with and pivotally hinged to the base. The package also includes a pair of vent members formed by the base and the two cover members when the package is closed. The cover members are held together in the closed position by mating interlocking structures on the two cover members. The package is specifically designed to hold the food items in an upright fashion, physically protect the food items, and display the food in an aesthetically pleasing fashion.

Elongated vegetables such as asparagus, celery, carrots and the like are commonly displayed in large bins in the produce sections of grocery stores. Often they are unpackaged. A supply of plastic bags is usually provided and the customers "package" the vegetables themselves. Otherwise, such vegetables are pre-packaged in plastic bags and left to lie in a pile in the bin.

Many grocers and customers find current methods of display unsanitary and unsatisfactory. Current display methods leave vegetables bruised, dirty and unappealing to customers. Finally, careless customers and stock clerks often drop the vegetables from the bin to the floor where they get dirty and stepped on, leaving an unappetizing mess.

In view of the foregoing, there is a real need for a suitable product which will permit vegetables, such as asparagus, to be displayed in an appealing, safe and sanitary manner. The present invention relates to a low cost, attractive package which meets the needs of product distributors, grocery stores and retail customers alike. Use of the package of the present invention permits the vegetables to be displayed and stored upright in a more sanitary and more appealing fashion.

SUMMARY OF THE INVENTION

The principle object of the invention is, therefore, to provide a container which promotes cleanliness and attractiveness of asparagus or other food items contained therein.

Another object of the invention is to provide a container which provides enclosure of the food item, yet is vented to inhibit spoilage.

Still another object of the invention is to provide a low cost, plastic container which holds the food item in an upright fashion for display purposes.

Yet another object of the invention is to provide a container which can be opened to remove part of the contents and re-sealed to again enclose the remainder.

Another object of the invention is to provide such a container which will protect the food item from being bruised, becoming dirty or being otherwise damaged.

To meet these and other objectives, the present invention relates to a container having a base and a pair of elongated cover members. The base includes a bottom wall, a side wall terminating in an outwardly projecting rim. The bottom wall, side wall and rim define an interior chamber having an open top. The two cover members are pivotally secured to and integral with the rim of the base. One of the cover members includes a plurality of male locking members. The other cover member includes an equal number of female locking members. To close the container, the two cover members are pivoted into a face-to-face registration in which the male and female locking members are mated to secure the cover members together. The design of the cover members is such that they form a second chamber open to the bottom. This bottom opening is in alignment with the open top of the chamber in the base. This alignment permits the lower portion of the asparagus to be stored in the first chamber and the upper portion to be stored in the upper chamber. Finally, when the cover members are latched together, they form, along with the base, a pair of opposing vents which permit air and moisture to enter and escape from the container.

Other features and advantages of the present invention will become apparent from the following detailed description of the preferred embodiment, the drawings, and the claims.

DETAILED DESCRIPTION OF THE PREFERRED EMBODIMENT

Figure 1:
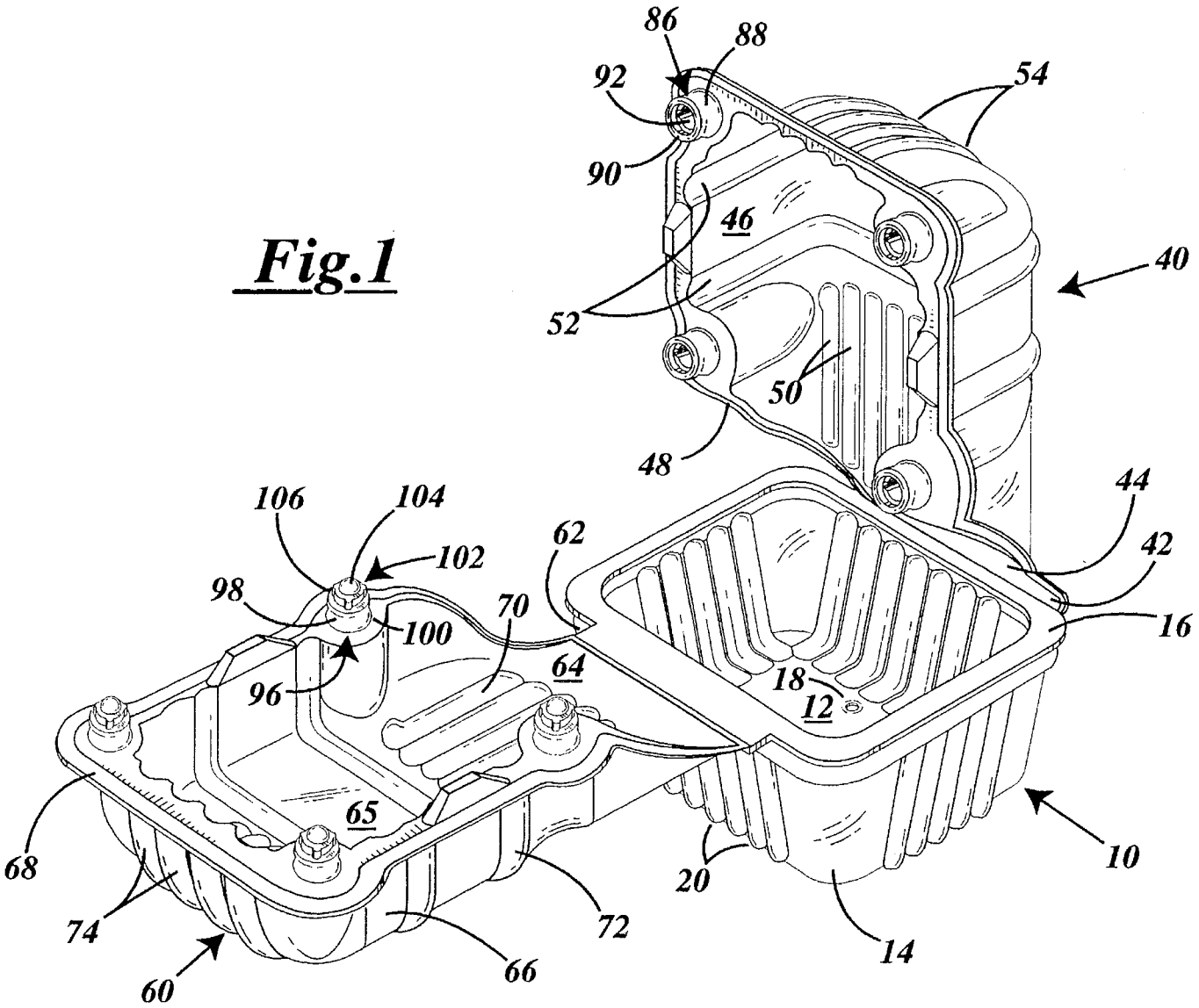
FIG. 1 is a perspective view of the container showing one of the cover members in the upright (closed) position and the other cover member in the open position.

As best shown in FIG. 1, the container of the present invention includes a base 10, a first cover member 40, and a second cover member 60. The base 10 includes a bottom wall 12, a side wall 14 integrally molded with and projecting upwardly from the periphery of the bottom wall 12, and an upper rim 16 integrally molded with and projecting outwardly from the upper end of the side wall 14. The bottom wall includes a drain hole 18. The side wall includes a plurality of flutes 20 to provide support and enhance durability.

As shown in the drawings, cover members 40 and 60 oppose each other. Cover member 40 is joined to the rim 16 of base 10 by a living hinge 42. Cover 60 is joined to the rim 16 of base 10 by a living hinge 62. This arrangement permits the base 10 and the two cover members 40 and 60 to be molded all at once when the container is made of plastic.

FIG. 1 also shows how the cover members 40 and 60 can be pivoted about the living hinges (42 and 62 respectively) between open and closed positions. In FIG. 1, cover member 40 is in the closed position and cover member 60 is the open position. FIGS. 2–6 all show both cover members in the closed position.

The drawings also show various components of cover members 40 and 60. Cover member 40 has a leg 44 projecting from the living hinge 42. Cover member 40 also has a main wall member 45 and a side wall member 46 projecting from the periphery of the main wall member 45. Projecting in a generally perpendicular fashion from the side wall portion 46 is a rim 48. The cover member 40 also has a first set of ribs 50, a second set of ribs 52 and a third set of ribs 54. These ribs provide support and rigidity. The ribs also define a flat panel 56 upon which a label can be placed. The label can be used to provide information related to the container or food stored therein.

Cover member 60 has a structure very similar to the structure of cover member 40. Cover member 60 has a leg 64 projecting from the living hinge 62. Cover member 60 also has a main wall portion 65 and a side wall member 66 which projects from the periphery of main wall member 65. Projecting in a generally perpendicular fashion from the side wall portion 66 is a rim 68. The cover member 60 also has a first set of ribs 70, a second set of ribs 72 and a third set of ribs 74. The ribs provide rigidity and support. Located between the ribs is a flat panel 76 upon which a label may be placed.

Figure 2:
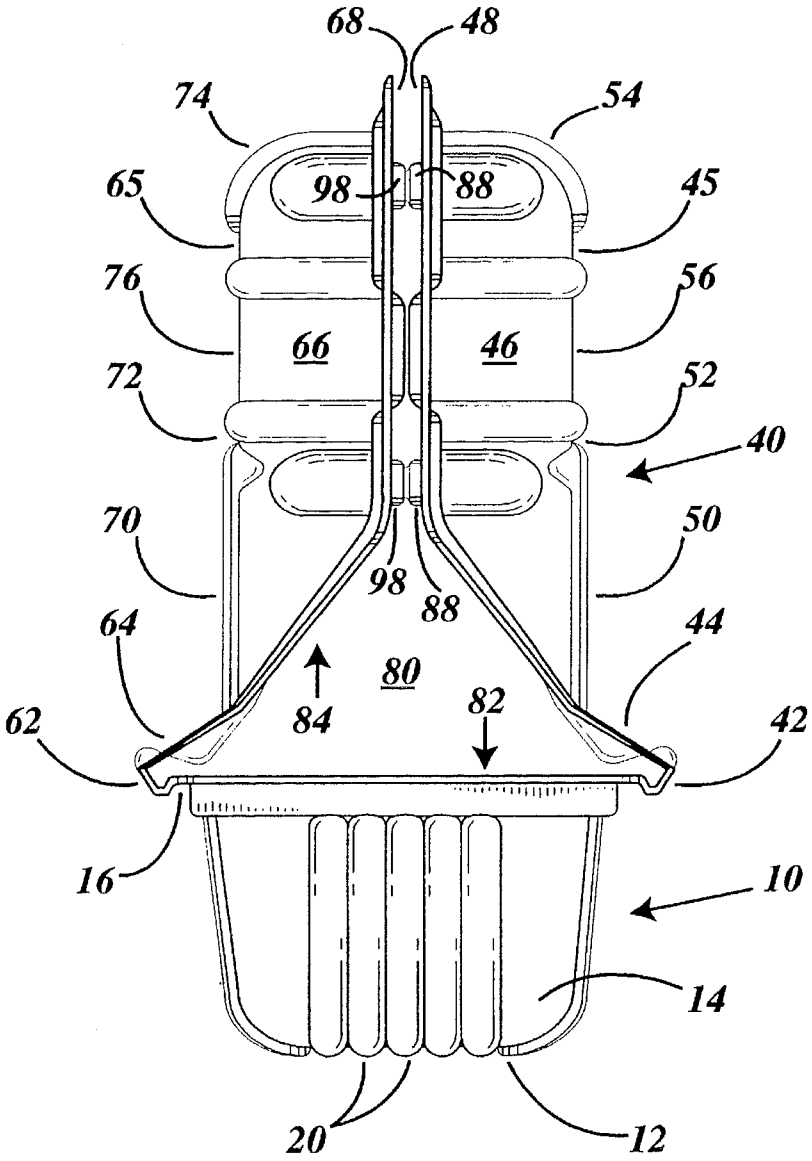
FIG. 2 is a plan view of one end of the container with both cover members in the closed position.
Figure 4:
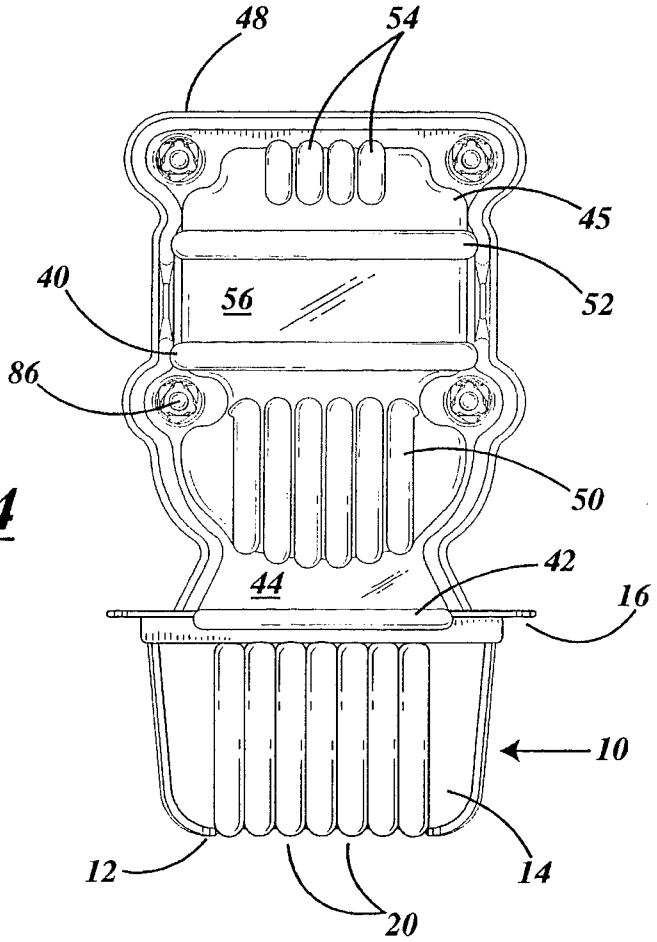
FIG. 4 is a plan view of the side opposite that shown in FIG. 3.
Figure 3:
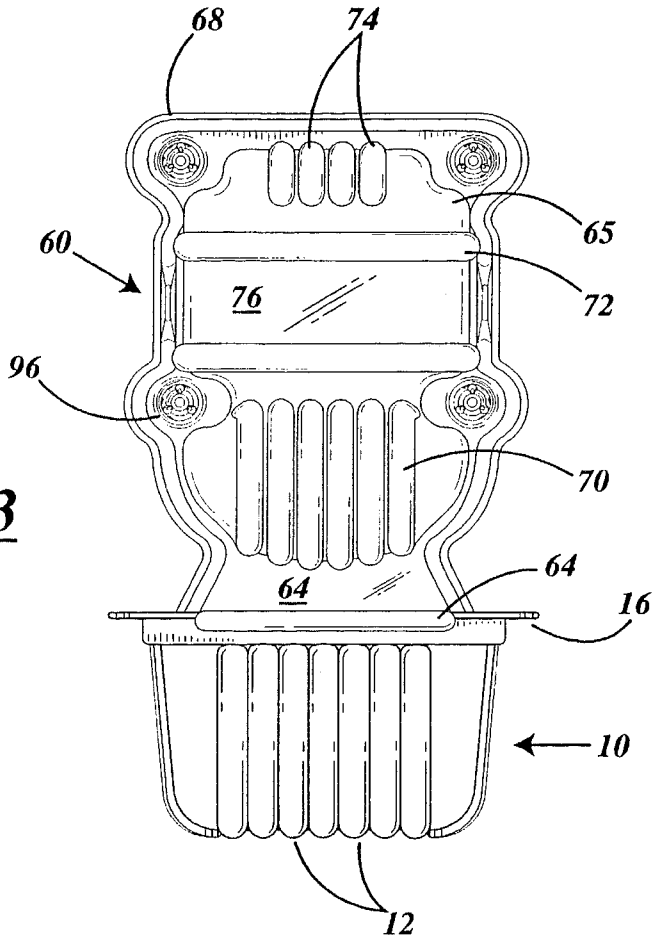
FIG. 3 is a plan side view of the container with the cover members in the closed position.
Figure 6:
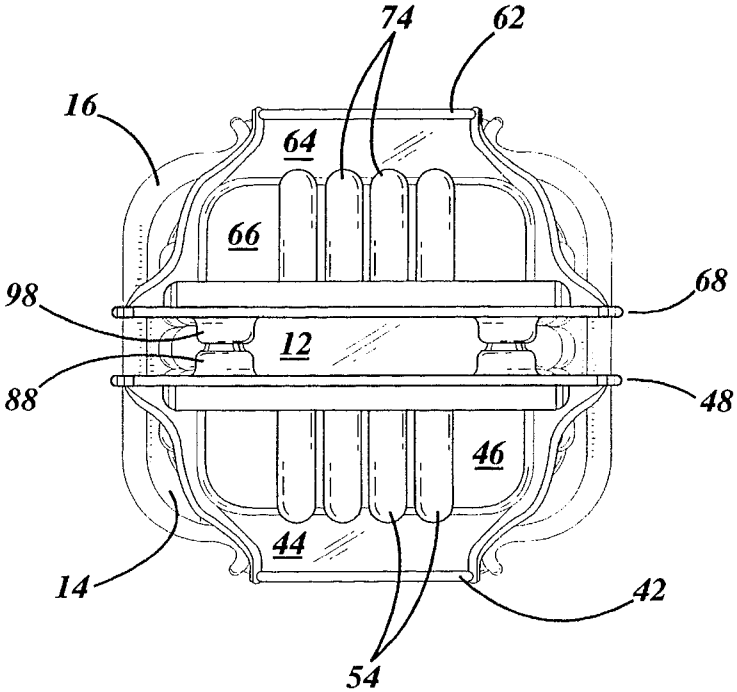
FIG. 6 is a top plan view with the cover members closed.
Figure 5:
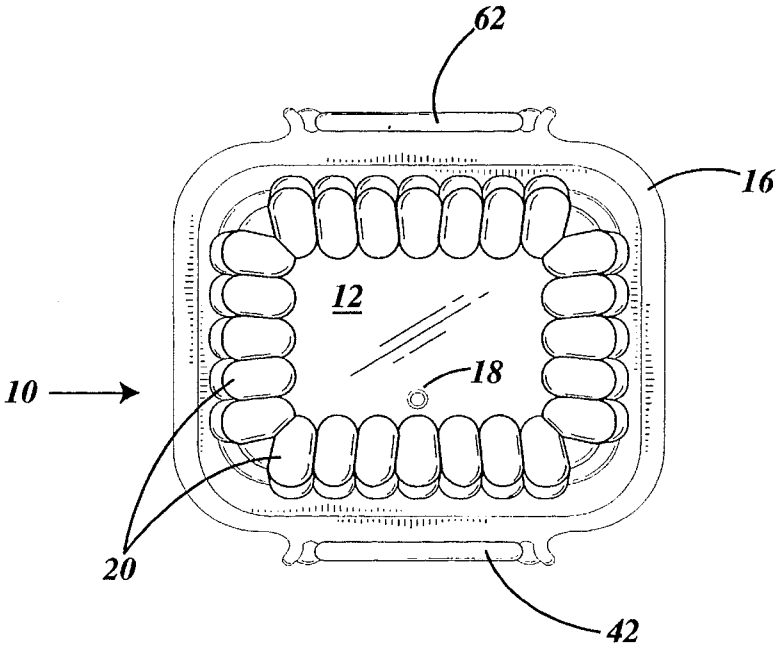
FIG. 5 is a bottom plan view with the cover member closed.

As best shown in FIG. 2, the legs 44 and 64, the side walls 46 and 66, and the rims 48 and 68 are tapered in such a way so as to form a pair of triangular shaped vents 80 when the two cover members 40 and 60 are joined together in the closed position. Vents 80 are relatively large and permit the free flow of air and moisture between the interior and exterior of the container.

When the covers 40 and 60 are closed, two interior chambers 82 and 84 are formed. The lower interior chamber 82 is formed by the bottom wall 12 and the side wall 14 of the base 10 and has an open top. The upper interior chamber 84 is formed by the main wall member 65 and side wall member 66 of cover member 60 and the main wall member 45 and side wall member 46 of cover member 40. The upper interior chamber has an open bottom which is aligned with the open top of the lower interior chamber.

The mechanism used to secure the two cover members 40 and 60 in the closed position will now be described. As shown in FIG. 1, cover member 40 includes four locking members 86 which project past the rim 48. Cover member 60 also includes four locking members 96 which project past the rim 68.

Figure 8:
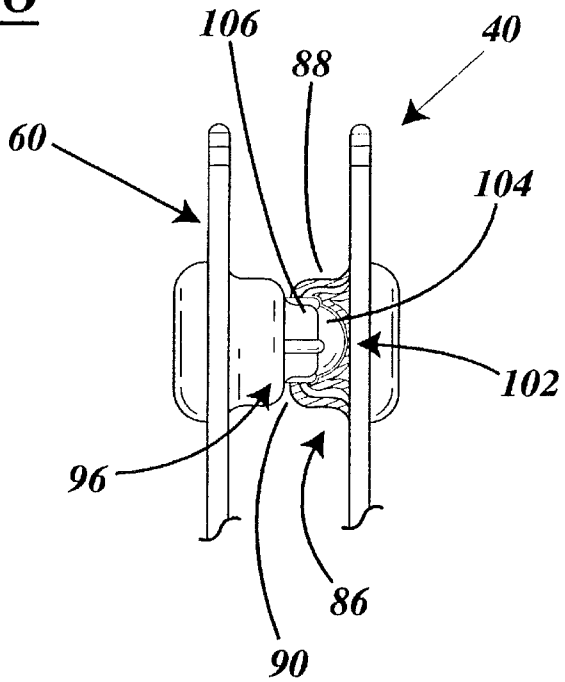
FIG. 8 is another drawing of the locking means showing how these components are situated and joined together.
Figure 7:
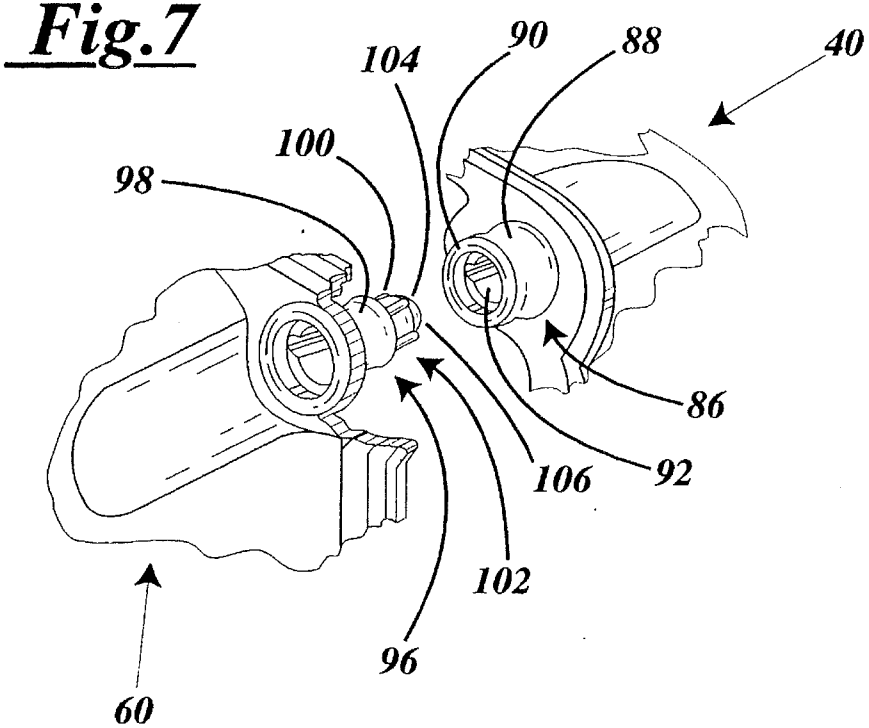
FIG. 7 is a more detailed drawing of the locking means used to secure the cover members in the closed position.

The structures of locking members 86 and 96 are shown in greater detail in FIGS. 7 and 8. The four locking members 86 each have a generally cylindrical side wall 88 and a generally flat end wall 90 which forms a catch around a center opening 92. Locking members 86 and 96 are positioned to be aligned with each other when cover members 40 and 60 are in there closed position. Locking members 96 each have a cylindrical side wall 98, and a generally flat end wall 100. Projecting from each end wall 100 is a tapered inserting member 102. As shown in FIG. 7, insertion member 102 has a generally conical tip 104 and a concaved center section 106 between tip 104 of the insertion member 102 and the end wall 100.

As the cover members are joined together in the closed position, locking members 86 and 96 are drawn into alignment with each other. The insertion members 102 of locking members 96 enter the center opening of the locking member 86. The insertion members 102 are then pushed until the conical tips 104 deflect and travel past the catches around the center openings 92. Once this happens, the cover members 40 and 60 are secured in the closed position. The catches surrounding openings 92 are positioned about the concaved center sections 106 of the insertion members 102 and between the end walls 100 and the widest part (or base) of the conical tips 104. The catches formed on cover member 40 and the wide part of the conical tips 104 of the insertion members 102 on cover member 60, thus, cooperate to hold cover members 40 and 60 in the closed position.

When one desires to open the container one simply inserts the thumbs of each hand through one of the vents 80. An outward force can then be applied to the rims 48 and 68 which is sufficient to deflect the catches surrounding the center openings 92 of the locking members 86 and release the insertion members 102 from the catches.

The containers of the present invention are particularly well suited to display long vegetables such as asparagus, carrots and celery. Such packages could also be used to store other long foods items such as bread sticks, pretzels or the like. Even non-food items could be stored without deviating from the invention.

Preferably, the containers are made of plastic. To allow retail customers to view the contents of the package, the plastic should be clear. However, a transparent colored plastic could also be used. Likewise, the base 10 could be made of an opaque plastic material and the cover members 40 and 60 made of a transparent plastic. Many other combinations of clear, transparent and opaque materials can be used in creating containers corresponding to the invention.

The preferred embodiment of the invention has been disclosed in detail along with certain alternative embodiments. However, the present invention is not limited to the embodiments disclosed herein. Various modifications may be made by those skilled in the art without deviating from the spirit, scope, or intent of the invention. Thus, the invention covers all such modifications falling within the scope of the follows claims:

What is claimed is:

1. A container, comprising:

a. a base, said base having 1) a bottom wall;

2) an upwardly projecting side wall having a lower end integral with the periphery of said bottom wall and an upper end;

3) a first interior chamber comprising the space defined by said bottom wall and side wall, said first interior chamber having an open top;

b. a cover having first and second cover members each having hinge means for joining said cover member to the base; each cover member being movable between an open position and a closed position about its hinge means; said first cover member having a plurality of male locking members and said second cover member having a plurality of female locking members capable of being aligned and mated with the male locking members of said first cover member to hold said first and second cover members in the closed position; said first and second cover members, when joined together in their closed position, forming (1) a second interior chamber having an open bottom, said open bottom being substantially aligned with the open top of said first interior chamber; and (2) at least one vent open to the exterior of the container; said male locking members have:

(a) a cylindrical side wall;

(b) a flat end wall; and (c) an insertion member having a conical tip and a concaved center section between the base of the conical tip and the flat end wall.

2. The container of claim 1 wherein said female locking members have:

(a) a cylindrical side wall;

(b) a flat end wall forming a catch around a center opening, said center opening sized to receive the conical tip of said insertion member and be positioned between the base of the insertion member's conical tip and the flat end wall of the male locking member when the first and second cover members are in the closed position.

3. A container, comprising:

a. a base, said base having 1) a bottom wall;

2) an upwardly projecting side wall having a lower end integral with the periphery of said bottom wall and an upper end;

3) a first interior chamber comprising the space defined by said bottom wall and side wall, said first interior chamber having an open top;

b. a cover having first and second cover members each having hinge means for joining said cover member to the base; each cover member being movable between an open position and a closed position about its hinge means; said first cover member having a plurality of male locking members and said second cover member having a plurality of female locking members capable of being aligned and mated with the male locking members of said first cover member to hold said first and second cover members in the closed position; said first and second cover members, when joined together in their closed position, forming (1) a second interior chamber having an open bottom, said open bottom being substantially aligned with the open top of said first interior chamber; and (2) at least one vent open to the exterior of the container; said container having a pair of generally triangular shaped, opposing vents formed by the base and cover when the cover members are in the closed position.

* * * * *